US010807618B2

(12) United States Patent
Westman

(10) Patent No.: US 10,807,618 B2
(45) Date of Patent: Oct. 20, 2020

(54) ASSEMBLY WITH A BEARING BRACKET AND A COUPLER ROD OR A CONNECTION ROD; CAR OF A MULTI-CAR VEHICLE AND METHOD FOR TRANSMITTING PUSHING FORCES APPLIED TO A COUPLER ROD OR CONNECTION ROD TO A BEARING BRACKET

(71) Applicant: Dellner Couplers AB, Falun (SE)

(72) Inventor: Anders Westman, Falun (SE)

(73) Assignee: Dellner Couplers AB, Falun (SE)

( * ) Notice: Subject to any disclaimer, the term of this patent is extended or adjusted under 35 U.S.C. 154(b) by 506 days.

(21) Appl. No.: 15/427,782

(22) Filed: Feb. 8, 2017

(65) Prior Publication Data

US 2017/0225696 A1 Aug. 10, 2017

(30) Foreign Application Priority Data

Feb. 10, 2016 (EP) ..... 16000327

(51) Int. Cl.

| | |
|---|---|
| ***B61G 7/10*** | (2006.01) |
| ***B61G 7/00*** | (2006.01) |
| ***B61G 9/06*** | (2006.01) |
| ***B61G 1/28*** | (2006.01) |
| ***B61G 1/40*** | (2006.01) |

(52) U.S. Cl.

CPC ..... *B61G 7/00* (2013.01); *B61G 1/28* (2013.01); *B61G 1/40* (2013.01); *B61G 7/10* (2013.01); *B61G 9/06* (2013.01)

(58) Field of Classification Search

CPC ... B61G 7/10; B61G 1/40; B61G 1/32; B61G 7/00; B61G 9/06; B61G 1/28

See application file for complete search history.

(56) References Cited

U.S. PATENT DOCUMENTS

| | | | | |
|---|---|---|---|---|
| 3,906,868 | A * | 9/1975 | Ksiensyk | B61G 7/10 213/64 |
| 5,360,124 | A | 11/1994 | Wurzer et al. | |
| 6,315,139 | B1 | 11/2001 | Kreher | |
| 8,714,376 | B2 | 5/2014 | Bartel | |

(Continued)

FOREIGN PATENT DOCUMENTS

| | | |
|---|---|---|
| CN | 1262651 A | 8/2000 |
| CN | 102076546 A | 5/2011 |

(Continued)

*Primary Examiner* — Scott A Browne

(74) *Attorney, Agent, or Firm* — Howard IP Law Group, PC

(57) ABSTRACT

A vehicle coupling assembly includes a bearing bracket, a rod, a pin and an abutment element. The bearing bracket includes compressible elements, a connection member intermediate the compressible elements, and a rear plate rearward of the connection member. The rod has an end wall, a first side of which is adjacent to one of the compressible elements. The pin extends through the compressible elements, a connection member hole defined in the bearing bracket, and an end wall hole of the rod. A pin support surface at a first pin end faces a first side of the connection member, one of the compressible elements being between the pin support surface and the second side of the connection member. The abutment element is at a second pin end, and abuts a second side of the end wall of the rod.

20 Claims, 4 Drawing Sheets

(56) References Cited

U.S. PATENT DOCUMENTS

| | | | | |
|---|---|---|---|---|
| 10,246,108 | B2 * | 4/2019 | Nikolaus | B61G 7/10 |
| 2009/0039044 | A1 * | 2/2009 | Krause | B61G 9/24 213/64 |
| 2009/0151595 | A1 | 6/2009 | Kontetzki | |
| 2010/0270253 | A1 * | 10/2010 | Kontetzki | B61G 7/10 213/185 |
| 2011/0094988 | A1 | 4/2011 | Bartel | |
| 2011/0297035 | A1 | 12/2011 | Langerwisch et al. | |
| 2015/0069002 | A1 * | 3/2015 | Stroud | B61G 7/10 213/7 |

FOREIGN PATENT DOCUMENTS

| | | | | |
|---|---|---|---|---|
| DE | 102008030284 | A1 | 12/2009 | |
| EP | 0 947 410 | A1 | 10/1999 | |
| EP | 1407953 | A1 * | 4/2004 | B61G 7/10 |
| EP | 1407953 | A1 | 4/2004 | |
| EP | 2 886 413 | A1 | 6/2015 | |
| EP | 2886413 | A1 | 6/2015 | |

* cited by examiner

ASSEMBLY WITH A BEARING BRACKET AND A COUPLER ROD OR A CONNECTION ROD; CAR OF A MULTI-CAR VEHICLE AND METHOD FOR TRANSMITTING PUSHING FORCES APPLIED TO A COUPLER ROD OR CONNECTION ROD TO A BEARING BRACKET

CROSS-REFERENCE TO RELATED APPLICATIONS

This application claims the benefit of priority under 35 U.S.C. § 119(a) to European Patent Application No. 16 000 327.3 filed Feb. 10, 2016, which is incorporated herein by reference in its entirety for all purposes.

FIELD OF THE INVENTION

The invention relates to an assembly with a bearing bracket and a coupler rod or a connection rod. The invention also relates to a car of a multi-car vehicle having a coupler rod or a connection rod for a connection to a further car of the multi-car vehicle. The invention also relates to a method of connecting a first car of a multi-car vehicle with a second car of the multi-car vehicle. The invention also relates to a method for transmitting pushing forces applied to a coupler rod or connection rod of such an assembly or such a car to the connection portion of such an assembly or car.

BACKGROUND OF THE INVENTION

Multi-car vehicles are known in different designs and in different forms of adaptation for uses. Multi-car vehicles, for example, railway-bound trains (streetcars and subway-trains also being considered as such trains) are known and are known for the purpose of transporting passengers as well as transporting goods. Further types of multi-car vehicles can be magnetic railway-trains or can be busses (road busses as well as busses traveling on fixed tracks). A car of a multi-car vehicle can be a self-supporting car, whereby the car has sufficient wheels that are placed at sufficient locations such that the car can stand by itself without being supported by other cars, for example, a three-wheeled car, a four-wheeled car or a car with even more wheels placed at suitable locations. A car of a multi-car vehicle can also be of the non-self-supporting type, whereby the car has no wheels or only wheels provided in such number or arranged at such a place that the car cannot stand by itself, but is vertically supported by at least one neighboring car.

To form the multi-car vehicles, the individual cars of the vehicle are connected to one another by means of a connecting device. The connecting device can be provided for different types of purposes. In multi-car vehicles where only one or only several of the total of cars is driven, the connecting devices are provided so that the driven car can drive the non-driven car and thus ensures that the complete vehicle travels with the same speed. Connecting devices are also distinguished between those connecting devices that allow for an easy decoupling of the cars, whereby easy decoupling is understood to be accomplished within a couple of minutes, or for what is called "semi-permanent" coupling of cars, for which decoupling of the cars takes efforts and usually involves the vehicle to have been transported to a specific workshop. Trains, for example, can have coupler-heads as a part of their connecting devices. These coupler-heads can, for example, be so-called "automatic couplers" that allow decoupling within minutes.

Regarding the design of the bearing bracket and the connection of the coupler rod or connection rod to the bearing bracket, at least two basic designs are known. One design is described in US 2009/0151595 A1 and EP 2 886 413 A1. In these designs, the bearing bracket comprises a joint typically provided by a vertically oriented pin, whereby the joint is arranged in such a manner that it allows the coupler rod or the connection rod to swivel relative to the bracket about at least one swivel axis. The second type of design is for example shown in EP 1 407 953 A1. Here, no vertically oriented pin as part of a joint is provided. Instead, a connection portion with a hole, a first support surface for a first rubber element and a second support surface for a second rubber element is provided, whereby the first support surface and the second support surface face in opposite directions. The design of the hole in the connection portions allows a pin that passes through the hole to swivel about an axis that is perpendicular to the central axis of the pin. The assembly according to the invention generally relates to this second type of design.

From EP 1 407 953 A1 an assembly with a bearing bracket and a coupler rod is known. The bearing bracket comprises a bracket that is basically provided in the form of one connection portion, namely a plate (Stützlagerplatte 4 in EP 1 407 953 A1). This plate is suitable for being connected to a car of a multi-car vehicle by way of the screws indicated in FIG. 1 in EP 1 407 953 A1 for example. The connection portion formed by the plate of the bracket of EP 1 407 953 A1 has a hole. It also has a first support surface for a first rubber element and a second support surface for a second rubber element, whereby the first support surface and the second support surface face in opposite directions. The first rubber element is made up of two doughnut-shaped rubber elements. The second support surface is made up of three doughnut-shaped rubber elements. The design of EP 1 407 953 A1 further shows that the coupler rod comprises an end portion that has a support surface for the first rubber element that faces the first support surface of the bracket. The first rubber element (the two doughnut-shaped rubber elements that form the first rubber element) is placed between the first support surface of the bracket and the support surface of the coupler rod. In this specific design shown in EP 1 407 953 A1, the left one of the two doughnut-shaped rubber elements that form the first rubber element of the design of EP 407 953 A1 is directly supported by the support surface at the end portion of the coupler rod; the right doughnut-shaped rubber element is directly supported by the first support surface of the bracket.

In the design of EP 1 407 953 A1 a pin passes through the hole of the bracket. The pin has a support surface for the second rubber element at one end that faces the second support surface of the bracket. The second rubber element being made up of three doughnut-shaped rubber elements is placed between the second support surface of the bracket and the support surface of the pin. In this specific design shown in EP 1 407 953 A1, the left one of the three doughnut-shaped rubber elements that form the second rubber element of the design of EP 407 953 A1 is directly supported by the second support surface of the bracket; the right doughnut-shaped rubber element is directly supported by the support surface of the pin. The pin also passes through a hole in the end portion of the coupler rod. A head of the pin is provided on this second end and acts as an abutment element abutting against a wall of the coupler rod that surrounds the hole provided in the end portion of the coupler rod.

As can be seen from FIG. 1 of EP 1 407 953 A1 the parts rearward of the connection portion of the design known from EP 1 407 953 A1, that is the parts behind the plate 4 are arranged within the underframe of the car. FIG. 1 shows the underframe of the car ("Tragwagenuntergestell" in EP 1 407 953 A1) and shows the rearward parts protruding into a hole in this underframe of the car. This provides the disadvantage that the car builders wanting to make use of such an assembly have to provide for room in the underframe of the car.

SUMMARY OF THE INVENTION

Given this background the problem to be solved by the invention is to suggest a solution that can do without parts that protrude into the underframe of the car.

This problem is solved by the assembly, the car and the methods described and illustrated herein.

The invention is based on the general concept to move the connection portion of the bracket forward and away from the car of the multi-car vehicle to which it is connected. This makes room for the elements of the assembly that are arranged behind the connection portion in relation to the coupler rod or connection rod arranged in front of the connection portion. In order to implement this concept, the invention suggests for the bracket to comprise a rear portion placed rearward of the connection portion, whereby the rear portion forms part of a car or is suitable for being connected to a car of a multi-car vehicle, and for the rear portion of the bracket to comprise a rear plate, whereby the bracket comprises at least one support element that connects the connection portion with the rear portion. The size of the at least one support element that connects the connection portion with the rear portion with regard to its extension in the direction from the connection portion to the rear portion can be chosen in order to create sufficient space for the elements of the assembly that are to be placed behind the connection portion.

The assembly according for the invention can be used with several types of connections that connect a first car of a multi-car vehicle to a second car of a multi-car vehicle. The coupler rod or connection rod used as part of the assembly according to the invention is thus adapted to this specific use of the assembly. As described above in the introduction, multi-car vehicles are formed by connecting individual cars of the vehicle to one another by means of a connection device. Such a connection device can have a coupler head as part of the connection device, which allows easy decoupling. If the assembly according to the invention is to be used in conjunction with such a connection, the assembly will have a coupler rod. In a different embodiment, where the cars of the multi-car vehicles do not need to be detached easily, the connection device that connects the car can simply be one connection rod that is attached at one end to one car using the bearing bracket according to the invention and is attached at its other end to a second car, preferably also using the bearing bracket according to the invention at this end.

BRIEF DESCRIPTION OF THE DRAWINGS

Below, the invention will be described with reference to the figures that only show exemplary embodiments of the invention.

DETAILED DESCRIPTION

Figure 2:
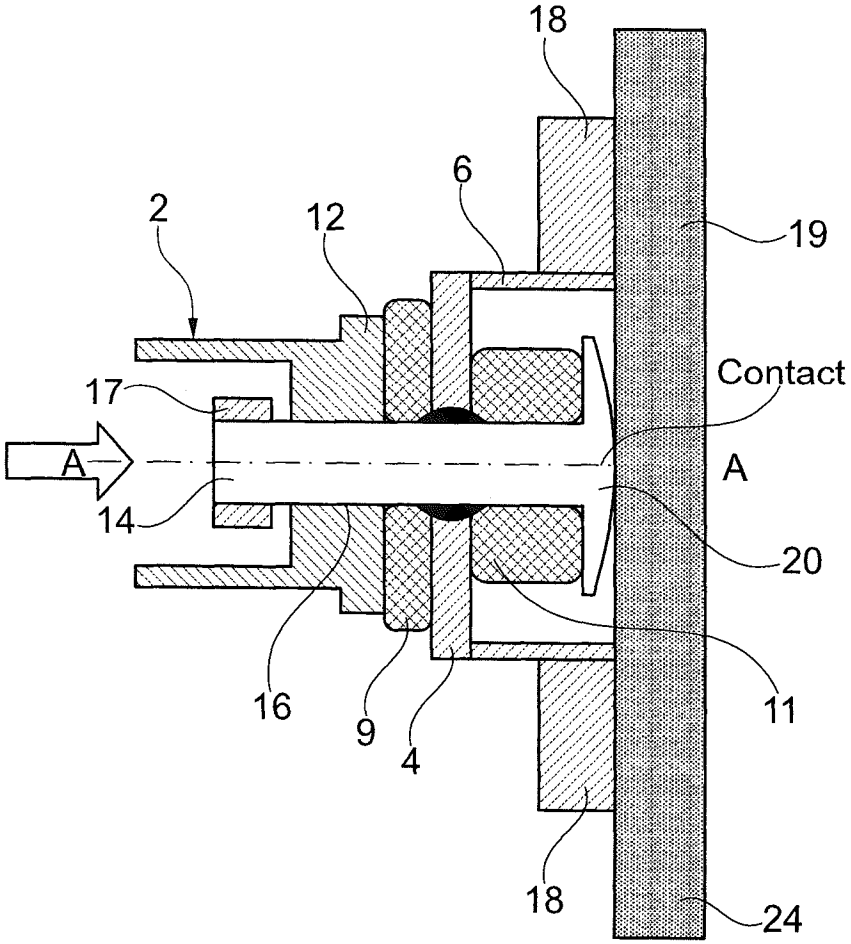
FIG. 2 is a schematic drawing of the embodiment of FIG. 1 in a second operational state.

To facilitate the discussion, the reference will be made below to "the rod" which is to be understood as reference to the coupler rod and the connection rod, depending on which of the two is used in this specific design of the assembly or the bearing bracket according to the invention.

The bearing bracket of the assembly according to the invention has a bracket forming part of a car or being a bracket suitable for being connected to a car of the multi-car vehicle. Often, bearing brackets are designed as pieces that are fitted to a car, whereby the car, for example the car's underframe is adapted to receive the bearing bracket, but whereby the bearing bracket is designed to provide its function only with pieces of the bearing bracket. For example designs are known, where the energy adsorption is provided by elements that form part of the bearing bracket. On the other hand, designs are known, where some of the functions of the bearing bracket, for example the energy adsorption, is provided by parts of the car, for example by deformation tubes arrange within the underframe of the car. For this reason, the invention is directed to both types of designs, namely on the one hand on designs where the bracket of the bearing bracket is designed to be suitable for being connected to a car of a multi-car vehicle and thus all primary functions being inherently provided by elements of the bearing bracket itself. In such an embodiment, the assembly will have a clear interface to the car, for example by flanges provided to be screwed to the car. If the connection between the flanges and the car is disconnected, the assembly can be taken away from the car as one piece. On the other hand, the invention is also directed to designs where the bracket forms part of a car, for example that parts of the bracket, for example parts of the rear part of the bracket form a part of the underframe of the car and thus some of the functions of a bearing bracket, for example the energy adsorption, is at least partially provided by elements of the car. As described below, in an especially preferred embodiment, all parts of the assembly but the rear plate of the rear part of the bracket can be detached from the car, but the rear plate is formed by a part of the wall of the car or a part of the underframe of the car. The term assembly in the present invention is only used to identify that group of elements that are relevant for the invention without implying that this group of elements essential for the invention needs to be a group of elements that can be separated from a wall of a car as group.

The bearing bracket can, for example, be made suitable for being connected to a car of a multi-car vehicle by having at least one hole through which a bolt can be placed in order to screw the bracket to a wall of the car or the underframe of the car. In an especially preferred embodiment, the bearing bracket has at least one flange having at least one hole through which a bolt can be placed in order to screw the bracket to the wall of a car or the underframe of a car. In a preferred embodiment, the bracket has two flanges arranged at opposite sides of the bracket, each flange having at least one hole for a bolt to be passed through in order to screw the bracket to a wall or the underframe of the car of a multi-car vehicle. As an alternative example, the bracket could have one ring-shaped flange that encircles the connection portion. Other ways of making a bracket suitable for being connected to a car of a multi-car vehicle can, for example, be the provision of surfaces that are provided in suitable locations to allow welding of these surfaces to the wall or the underframe of the car. Also a socket-joint could be provided as part of the bracket.

The bearing bracket comprises a bracket that has a connection portion. The connection portion is provided for connecting the bearing bracket to the rod. The connection portion can be a plate. The connection portion can be a substantially plane part of a three dimensional object, for example a cast object, for example a cast metal object, for example a cast iron object. The term "plane" in this description being used in the sense of flat, even or if used in the context of describing surfaces in the sense of generally in one plane. In order to save weight or in order to provide room for the rubber element, the wall thickness of the connection portion, if designed as a plate or if designed as a plane part of a three dimensional object can vary. The wall thickness can thicken towards an area surrounding a hole and/or can thicken towards the ends of the plate or the plane part of the three-dimensional object, but can in a preferred embodiment be of reduced wall thickness in parts there between.

The connection portion has a hole. As will be described in more detail further below, a pin passes through the hole of the bracket.

The connection portion has a first support surface for a first rubber element and a second support surface for a second rubber element, the first support surface and the second support surface facing in opposite directions. In a preferred embodiment, the first support surface surrounds the hole of connection portion. In a preferred embodiment, the second support surface surrounds the hole in the connection portion. The first support surface and/or the second support surface can be plane. In a preferred embodiment, the first support surface and/or the second support surface have a three-dimensional shape. In a preferred embodiment, the first support surface and/or the second support surface have a ring-shaped core part that is plane and is arranged around the hole of the connection portion, whereby an outer rim section is provided, where the respective part of the support surface is provided by the surface of a rim-shaped trough surrounding the hole. Proving such a trough allows for additional space that can be taken up by the rubber material, for example if the rubber element is been compressed by a pushing force acting on the rod that pushes the rod towards the connection portion while at the same time the rod has swiveled about a swivel axis in the connection portion.

Although the first support surface and the second support surface are being referred to as "support surfaces" in this description, this does not mean, that the respective support surface needs to be in direct contact with the respective rubber element it is to support. Additional elements, like plates, for example like a tilt plate as shown with reference number 9 in FIGS. 2 and 3 of DE 10 2008 030 284 A1 can be provided between the rubber element and the respective support surface. The term support surface is to be understood as describing a surface that takes part in introducing compressing forces into the rubber element be it via direct surface contact with the rubber element or the be it via intermediate contact through further elements being arranged in the flow of force from the respective support surface to the respective rubber element. In a preferred embodiment a support surface either makes direct surface contact with a rubber element or makes contact with the respective rubber element only by a tilt plate being inserted in-between the respective support surface and the respective rubber element, with no further elements being arranged between the support surface and the rubber element.

The rod comprises an end portion. This end portion can be provided directly on the rod itself in the sense of the rod being a unitary, one piece body. Alternatively, the end portion of the rod is formed by an end piece being attached to the remainder of the rod. The attachment preferably is fixedly, but detachable. If the attachment is made detachable, the assembly with the detached end portion of the rod staying in place can be left on a car, while the remainder of the rod is detached from the end portion. Such a detachable connection between the end portion of the rod and the rod could be used as an easy way to attach and detach two cars of a multi-car vehicle.

The end portion of the rod has a support surface for the first rubber element that faces the first support surface of the bracket. The same understanding regarding the term "support surface" applies here as for the first support surface and the second support surface of the connection portion. In a preferred embodiment, the support surface on the end portion of the rod is a plane surface. The support surface on the end portion can be plane. In a preferred embodiment, the support surface on the end portion has a three-dimensional shape. In a preferred embodiment, the support surface has a ring-shaped core part that is plane and is arranged around the hole of the end portion, whereby an outer rim section is provided, where the respective part of the support surface is provided by the surface of a rim-shaped trough surrounding the hole. Proving such a trough allows for additional space that can be taken up by the rubber material, for example if the rubber element is been compressed by a pushing force acting on the rod that pushes the rod towards the connection portion while at the same time the rod has swiveled about a swivel axis in the connection portion.

The first rubber element is placed between the first support surface of the bracket and the support surface of the rod (the support surface provided on the end portion of the rod).

The assembly according to the invention has a pin that passes through the hole of the bracket, the pin having a support surface for the second rubber element at one end (the first end) that faces the second support surface of the bracket, whereby the second rubber element is placed between the second support surface of the bracket and the support surface of the pin. The support surface on the pin can be plane. In a preferred embodiment, the support surface on the pin has a three-dimensional shape. In a preferred embodiment, the support surface has a ring-shaped core part that is plane and is arranged around in the middle, whereby an outer rim section is provided, where the respective part of the support surface is provided by the surface of a rim-shaped trough surrounding middle portion. Proving such a trough allows for additional space that can be taken up by the rubber material, for example if the rubber element is been compressed by a pushing force acting on the rod that pushes the rod towards the connection portion while at the same time the rod has swiveled about a swivel axis in the connection portion.

The pin also passes through a hole in the end portion of the rod, whereby an abutment element is provided on the second end of the pin, the abutment element abutting against a wall of the rod that surrounds the hole provided in the end portion of the rod. This wall can be the same wall that on its other side has the support surface for the first rubber element that faces the first support surface of the bracket. The wall can, however, also be a separate wall, for example of a piece that is arranged separately, but prefatory in contact with the piece that provides the support surface for the first rubber element that faces the first support surface of the bracket.

The assembly according to the invention comprises a rear portion that is placed rearward of the connection portion. The term "rearward" is to be understood to refer to the other side of the connection portion in relation to the rod, which is understood to be on the forward side of the connection portion and depending on the context is to be understood to be the direction that points from the connection portion away from the rod. The term "rearward of the connection portion" referring to that side of the connection portion, where the one end of the pin is arranged that faces the second support surface of the bracket. The rear portion of the bracket forms a part of a car or is being suitable for being connected to a car of a multi-car vehicle. The rear portion can thus be a part of a wall of a car of a multi-car vehicle or can be a part of the underframe of the car of a multi-car vehicle. The rear portion can, however, also be a separate element that is not an element that is generally perceived to form part of a car of a multi-car vehicle and that is, being a separate element, attached to the car of a multi-car vehicle. The rear portion can also be put together of several elements, some of the elements being a separate element that is not an element that is generally perceived to form part of a car of a multi-car vehicle and that is, being a separate element, attached to the car of a multi-car vehicle and can be detached from the car, while other elements are elements that are generally perceived to form part of a car of a multi-car vehicle, like walls and underframes. In a preferred embodiment, the rear portion of the bracket comprises at least one flange, preferably two flanges arranged at opposite sides of bracket, the flanges having holes to allow bolts to pass through to attach the flange to a wall or an underframe of the car. In a preferred embodiment, the flanges can be attached to the car of a multi-car vehicle and can be detached from the car, while the rear part further comprises a rear plate that is formed by at least a part of the wall or the underframe of the car. In an even more preferred embodiment, the rear plates reaches from one flange to the another flange of the bracket.

The bracket comprises at least one support element that connects the connection portion with the rear portion. The support element can for example be a hollow cylinder, one end of the hollow cylinder being connected to the rear portion and of the hollow cylinder being connected to the connection portion. The cross section of the hollow cylinder in a plane perpendicular to the central axis of the hollow cylinder can have the shape of a circular ring, of an elliptical ring or a rectangular ring, preferably a square ring. The support element could also have the shape of a hollow cone The cross section of the hollow cone in a plane perpendicular to the central axis of the hollow cone can have the shape of a circular ring, of an elliptical ring or a rectangular ring, preferably a square ring. If a cone is used, preferably the larger cross section of the cone is at the rear portion and the smaller cross section at the connection portion. The support element can also simply be a pillar that connects the connection portion with the rear portion. It can also be made up of several pillars. Or it can be made up of one plate or several plates. In a preferred embodiment, the support element is rigged and does not change shape if a pushing force is applied to the rod that pushes the rod towards the connection portion. In a preferred embodiment, the support element is not designed as an energy adsorbing element, for example is not designed as a deformation cube.

In a preferred embodiment, the support element does not form part of the car and can be attached and detached from parts of the car, especially can be detached from a wall or an underframe of the car by being connected to a part of the rear part of the assembly that can be attached and detached from the wall or the underframe of the car.

In a preferred embodiment the connection portion and the support element or the support element and the rear portion or the connection portion and the rear portion and the support element are parts of one unitary piece, especially preferred a cast piece, especially preferred a metal cast piece, especially preferred a piece cast from cast iron.

In a preferred embodiment, the abutment element provided on the second end of the pin is a screw that is screwed onto a thread provided on the second hand of the pin. This provides an easy way of dismantling and putting together the assembly. Alternatively, the abutment element can be an enlargement provided at the second end of the pin that is larger than the hole in the end portion of the rod through which the pin passes. Such an enlargement can be provided by cold-deforming the second end of the pin after it has passed through the hole in the end portion of the rod or by way of forging.

In a preferred embodiment, the support surface for the second rubber element provided on the pin is a part of an end-plate provided at the first end of the pin. In a preferred embodiment, the endplate of the pin is a circular plate. In a preferred embodiment, the endplate is made as one piece with the remaining part of the pin or is welded to the remaining part of the pin. In a preferred embodiment, the endplate of the pin is not held in place on the pin by way of a screw, screwed onto a thread of the pin. However, there are also designs feasible, where the endplate of the pin is a separate piece from the remainder of the pin and is held in place by a screw, screwed on a thread of the pin or by an enlargement, for example a knob, at the end of the pin against which the endplate is pushed.

In a preferred embodiment the endplate has a rearward facing surface that faces the rear plate. In a preferred embodiment, of the rod is placed in a position suitable for the multi-car vehicle to drive in a straight line, the rear plate is arranged behind the rearward facing surface of the endplate. In a preferred embodiment, the rearward facing surface of the endplate is beveled, especially preferred has the shape of the part of the surface of a ball or a sphere. In a preferred embodiment, the endplate is arranged distanced from the rear plate, if no pushing force is applied to the rod that pushes the rod towards the connection portion. This allows the rod to freely swivel relative to the connection portion without any friction or any damages occurring to the rear plate.

In a preferred embodiment, the endplate contacts the rear plate, if a pushing force of a first predetermined magnitude is applied to the rod that pushes the rod towards the connection portion. This can be used to limit the travel of the pin towards the rear plate.

In a preferred embodiment the endplate contacts the rear plate, if a pushing force of a first predetermined magnitude is applied to the rod that pushes the rod towards the connection portion, whereby the abutment element provided of the second end of the pin comes out of the contact with the wall of the rod that surrounds the hole provided in the end portion of the rod, if a pushing force of a second predetermined magnitude that is larger than the first predetermined magnitude is applied to the rod that pushes the rod towards the connection portion. In a preferred embodiment, the pin is a solid piece that is not deformed in its linear extent in the normal driving conditions of the multi-car vehicle. This means that the distance between the abutment element and the endplate of the pin stays the same. This means that if the abutment element lifts off from the wall of the rod that the pin moves or has moved further through the hole in the end portion of the rod. This means, that the rod, even if pushed further towards the connection portion does not push the pin towards the rear plate with the same amount of force as before. Even more preferred, if the design of the hole in the end portion of the rod and the pin is made such that no relevant friction forces are transmitted from the end portion of the rod onto the pin as the pin slides further through the hole the fact that the pin has slit further to the hole means that hardly any or no further pushing forces are transmitted onto the pin that would push the endplate of the pin further against the rear plate.

The above design can limit the decompression stroke of the second rubber element, depending on the amount the second rubber element has been compressed. The position of the first support surface relative to the support surface on the end portion of the rod and the position of the second support surface relative to the support surface on the pin is detrimental by the elasticity of the first rubber element and the elasticity of the second rubber element. The distance between the first support surface and the support surface on the end of the rod does not need to be the same distance as the distance between the second support surface and the support surface on the pin. In a preferred embodiment, it is the same distance. As the rod is pushed by a pushing force towards the connection portion, the first rubber element arranged between the support surface of the end portion of the rod and the first support surface is compressed. At the same time, because the pin and the support surface arranged on the pin is moved rearwards, the distance between the second support surface and the support surface of the pin is increased, which allows the second rubber element to decompress, if it was in a compressed state. If no rear plate was present, the more the first rubber element would be compressed and the more the support surface of the pin would move away from the second support surface, the more the second rubber element would decompress. If according for the preferred embodiment, the end plate of the pin contacts the rear plate, this contact limits the distance between the support surface on the pin and the second support surface and hence limits the amount of decompression of the second rubber element.

In a preferred embodiment, the first rubber element comprises a hole through which the pin passes. In a preferred embodiment, the first rubber element comprises a ring-shaped rubber element. In a preferred embodiment, the ring-shaped rubber element is a doughnut-shaped rubber element. The ring-shaped rubber element does not need to have the exact shaped of a doughnut, however. It is also feasible that the ring-shaped rubber element has at least one concave side surface, where a doughnut-shaped ring-shaped rubber element would have convex side surfaces. The first rubber element can have a package of several ring-shaped rubber elements as can be seen in EP 1 407 953 A1, for example.

In a preferred embodiment, the second rubber element comprises a hole through which the pin passes. In a preferred embodiment, the second rubber element comprises a ring-shaped rubber element. In a preferred embodiment, the ring-shaped rubber element is a doughnut-shaped rubber element. The ring-shaped rubber element does not need to have the exact shaped of a doughnut, however. It is also feasible that the ring-shaped rubber element has at least one concave side surface, where a doughnut-shaped ring-shaped rubber element would have convex side surfaces. The second rubber element can have a package of several ring-shaped rubber elements as can be seen in EP 1 407 953 A1, for example.

The first rubber element and/or the second rubber element can also be provided by pads that are arranged between the respective support surfaces. Preferably first rubber element and/or the second rubber element are made up of several pads each that are arranged between the respective support surfaces. Preferably, the several pads are arranged symmetrically around the central axis of the pin, preferably in rotational symmetry about the central axis of the pin or in point symmetry about the central axis of the pin.

In a preferred embodiment, a ball or a cylinder is arranged inside the hole of the connection portion, whereby the ball or the cylinder can swivel relative to the connection portion at least about one swivel axis and whereby the pin passes through the ball or the cylinder. In order to allow the rod to swivel relative to the connection portion at least about one swivel axis, the hole in the connection portion can be cone-shaped or double cone-shaped as shown in EP 1 407 953 A1. It is preferred, however, if a ball or a cylinder is provided in the hole, however, as this improves the swivel movement and also prevents the hole from being enlarged over the lifetime of the assembly. In a preferred embodiment the ball or cylinder is of stiff material that does not deform under the normal load applied during the normal operational conditions of the multi-car vehicle. In a preferred embodiment, the ball is made of plastic or of metal, especially preferred of brass or of copper or of bronze.

In a preferred embodiment the first rubber element and/or the second rubber element are in a compressed state, if no pushing force is applied to the rod that pushes the rod towards the connection portion. Compressing the rubber elements creates a pretension of the connection portion into the preferred position. In a preferred embodiment the compression of the second rubber element is chosen in relation to the distance that the endplate of the pin has to the rear plate such that when the pin has been pushed backwards by a force applied to the rod that pushes the rod towards the connection portion so far that the endplate of the pin contacts the rear plate and the abutment element lifts off from the wall of the rod that only a small expanding force of the second rubber element remains that pushes the endplate of the pin against the rear plate. In a preferred embodiment, this small force is of a magnitude below 100 kN, especially preferred below 60 kN. In a preferred embodiment, the pretention of the second rubber element is chosen in relation to the magnitude of the forces that can be transmitted from the rod via the bracket to the car such that the magnitude of the forced with which the endplate of the pin is pressed against the rear plate is less than 10%, preferably less than 5% and especially preferred less than 1% of the magnitude of the force that can be transferred from the rod via the bracket to the car without destroying any of the parts in the flow of force from the rod via the bracket to the car.

In a preferred embodiment the hole in the end portion of the rod linearly guides the pin and prevents a swivel movement of the pin relative to the end portion of the rod about a swivel axis that is perpendicular to the central axis of the pin. This preferred embodiment ensures that a swivel motion of the rod relative to the bracket takes place only at the connection portion and not between the rod and the pin. The linear guide can be provided by a hole or a bush with close tolerance of it inner diameter in relation to the outer diameter of the pin. Using a bush inserted in the hole of the portion in order to provide a linear guidance for the pin has the advantage, that the material for the bush can be purposefully chose to provide good guidance, while at the same time proving low friction in order to allow the pin to be moved through the hole, for example for the driving condition, where the abutment element is to lift off from the wall.

In a preferred embodiment a tilt plate is arranged between the end portion of the rod and the first rubber element, whereby a part of the tilt plate comes into contact with the connection portion, if the coupler rod or connection rod swivels relative to the connection portion about an swivel axis that is perpendicular to the central axis of the pin. Such tilt plates have been described in DE 10 2008 030 284 A1 and are called "Richtgelenkschwingplatte" in DE 10 2008 030 284 A1. The disclosure of possible designs and possible placements relative to rubber elements and with regard to the functionality of such a tilt plate of DE 10 2008 030 284 A1 is in cooperated by reference into this description and forms part of this description with regard to the possible designs, the possible placements and the functionality of the tilt plate provided in this preferred embodiment.

In a preferred embodiment the end portion of the rod can have a protrusion that partially protrudes past the first rubber element, whereby the protrusion of the end portion comes into contact with the connection portion, if the rod swivels relative to the connection portion about a swivel axis that is perpendicular to the central axis of the pin. Such a protrusion is described in EP 1 407 953 A1 as rim (Rand 9). The disclosure of possible designs and possible placements relative to rubber elements and with regard to the functionality of such a protrusion protruding from an end portion of the rod of EP 1 407 953 A1 is in cooperated by reference into this description and forms part of this description with regard to the possible designs, the possible placements and the functionality of the protrusion on the end portion of the rod provided in this preferred embodiment.

In a preferred embodiment the rear plate has an elastic insert placed at a location, where the end plate of the pin would most likely contact the rear plate, if a pushing force of a predetermined magnitude is applied to the rod that pushes the rod towards the connection point. The elastic insert could for example be a rubber element inserted into a recess of the wall. In a preferred embodiment, the elastic insert has an outward facing surface that is flush with the remaining surface of the rear plate.

The assembly according to the invention can comprise energy absorbing elements in addition to the first rubber element and the second rubber element. These energy absorbing elements can assist in damping forces that are transmitted from one car to a second car of a multi-car vehicle. Such energy absorbing elements can for example be gas-hydraulic buffers arranged in the rod. Energy absorbing elements are understood to be elements that can take up energy. These elements are either designed to return at least a part of the energy later, like springs, or these elements are designed as energy adsorbing elements, that take up energy, but do not return the energy. Such energy adsorbing elements are for example deformation tubes arranged in the rod.

The invention also relates to a car of a multi-car vehicle having a rod for a connection to a further car of the multi-car vehicle. According to the invention, this car is provided with an assembly according to the invention. In a preferred embodiment, the rear plate of the rear portion of the bracket of the bearing bracket of the assembly is provided by a portion of a wall of the body of the car or a portion of the underframe of the car. In a preferred embodiment, there is a closed wall (which functions as the rear plate of the assembly) behind the bracket. This allows the car-builders to design the cars of the multi-car vehicle without having to provide special shapes, especially recesses or holes in order to ensure the functionality of the elements necessary to connect the cars of the multi-car vehicle. The freedom of the car-builders in designing the car is therefor increased. They can provide closed surfaces on the walls and closed surfaces on the underframe of the car in the surroundings of the assembly, because the assembly according to the invention allows for a rear plate to be placed behind the connection portion and does not necessitate holes or recesses to be provided here.

In a preferred embodiment the wall of the body of the car and/or the underframe of the car behind the connection portion of the bracket of the bearing bracket has no hole or recess that is large enough to insert the first end of the pin and/or the second rubber element into it. It might be necessary to provide small holes in the wall and/or the underframe of the car, for example to pass electric cable or pneumatic cables through it or for using them for bolts in order to attach the assembly. Contrary to the design known from EP 1 407 953 A1 the invention in a preferred embodiment does not, however foresee a large hole or recess in the wall of the body of the car or the underframe of the car as it is made necessary for the design for EP 1 407 953 A1, namely in order to allow the first end of the pin and the second rubber element to be inserted into such a hole or recess.

The invention also relates to a method of connecting a bearing bracket and a coupler rod or a connection rod attached to the bearing bracket to the wall or the underframe of a car, whereby the bearing bracket comprises a bracket being suitable for being connected to a car of a multi-car vehicle, the bracket having a connection portion with a hole, a first support surface for a first rubber element and a second support surface for a second rubber element, the first support surface and the second support surface facing in opposite directions,

1 comprises an end portion that has a support surface for the first rubber element that faces the first support surface of the bracket, the first rubber element being placed between the first support surface of the bracket and the support surface of the coupler rod or connection rod, whereby a pin passes through the hole of the bracket, the pin having a support surface for the second rubber element at one end that faces the second support surface of the bracket, the second rubber element being placed between the second support surface of the bracket and the support surface of the pin, whereby the pin passes through a hole in the end portion of the coupler rod or connection rod and whereby an abutment element is provided on the second end of the pin, the abutment element abutting against a wall of the coupler rod or connection rod that surrounds the hole provided in the end portion of the coupler rod or connection rod, whereby the support surface for the second rubber element provided on the pin is part of an end-plate provided at the first end of the pin and in that the end plate has a rearward facing surface, whereby the bracket comprises a rear portion placed rearward of the connection portion, the rear portion being suitable for being connected to a car of a multi-car vehicle, whereby the bracket comprises at least one support element that connects the connection portion with the rear portion, the method providing that the rear portion is connected to the car in such a manner that the rearward facing surface of the end plate is arranged distanced from a rear plate formed by a wall of the car or formed by the underframe of the car, if no pushing force is applied to the coupler rod or connection rod that pushes the coupler rod or connection rod towards the connection portion.

In a preferred embodiment, the above described method is used to connect the at least parts of the assembly according to the invention to a car of a multi-car vehicle, while other parts, like the rear plate can be provided by the car, for example a wall or the underframe of the car.

The invention also relates to a method for connecting a first car of a multi-car vehicle with a second car of the multi-car vehicle. This method provides for connecting an assembly according to the invention to the first car and connecting a coupler provided on the coupler rod of the first car to a coupler provided on a coupler rod of a second car or in an alternative provided for connecting the connection rod of the assembly according to the invention to the second car. In a preferred embodiment it is provided as part of the method step of connecting the assembly according to the invention to the first car that the bracket belonging to the assembly of the invention is connected to the car with its rear portion, for example by way of using flanges provided at the rear portion of the bracket, without the complete coupler rod or connection rod being already part of the assembly. As discussed above, the end portion of the rod can be a detachable part of the rod. It is thus possible to design the assembly according to the invention in such a manner that the bracket, the pin and the end portion of the rod resting on the pin are connected to the first car. In a second method step that belongs to the overall method step of connecting the assembly according to the invention to the first car, the remaining parts of the rod are connected to the end portion. Especially when used in connection with connection rods, which typically are more difficult to connect to each other in comparison to coupler rods with coupler heads, this embodiment provides advantages that facilitate the connecting of a first car of a multi-car vehicle with a second car of the multi-car vehicle.

In a preferred embodiment, this method is applied by using a car according to the invention.

The invention also relates to a method for transmitting pushing forces that are applied to a coupler rod or a connection rod of an assembly according to the invention or a car according to the invention to the connection portion of the assembly or the car. The aim of the method thus is to provide for a way to transmit pushing forces from the rod to the connection portion of the assembly and hence ultimately to a wall of the body of the car or the underframe of the car. In the method, the pushing force is applied to the rod in such a way as to push the rod towards the connection portion of the assembly or the car. The method according to the invention is characterized by providing two different types of transmitting the forces depending on the level of pushing force applied. According to the method of the invention, if a pushing force below a first predetermined level is applied, the first rubber element is compressed and the second rubber element is allowed to decompress without the endplate of the pin contacting the rear plate. According to the method of the invention, if a pushing force above the predetermined level is applied, the first rubber element is further compressed, but the second rubber element does not further decompress, because the endplate of the pin contacts the rear plate and the abutment element lifts off from the wall of the rod that surrounds the hole provided in the end portion of the rod.

Figure 1:
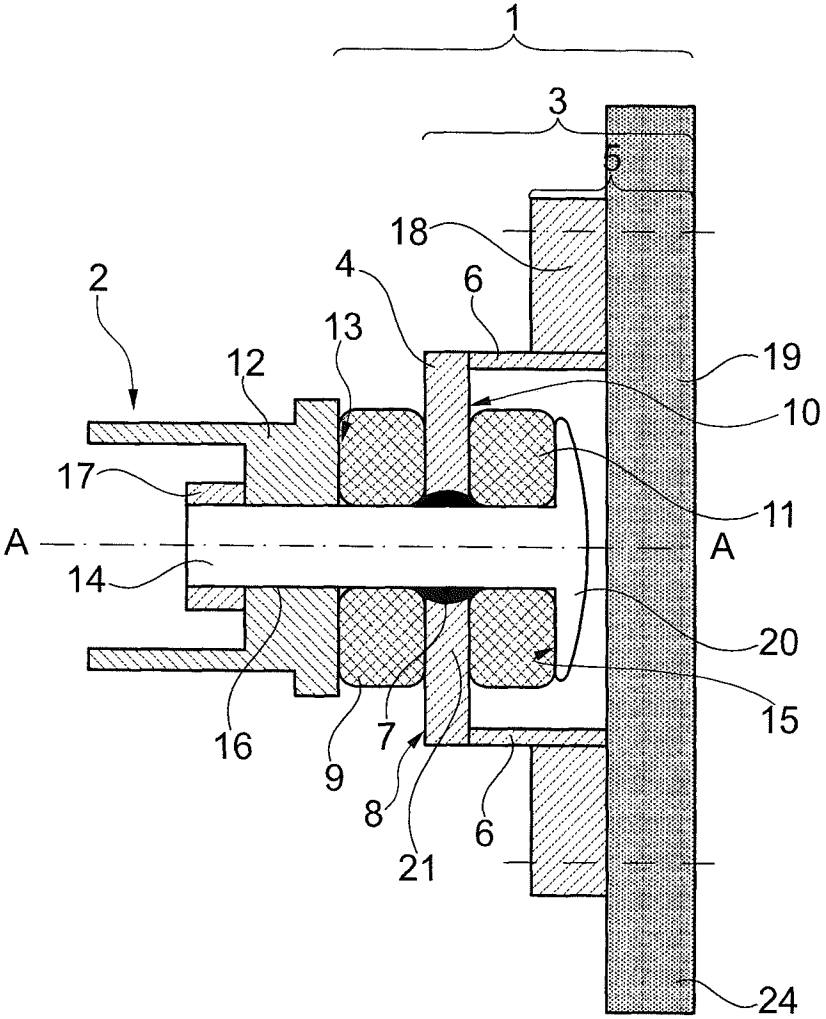
FIG. 1 is a schematic drawing of a first embodiment of the assembly according to the invention in a first operational state.

FIG. 1 shows a schematic drawing of a first embodiment of the assembly according to the invention in a first operational state. The assembly has a bearing bracket 1 and a rod 2 that could be a coupler rod and in this embodiment would then have a coupler attached to end of the rod or could be a connection rod that could be directly connected to a further assembly of the invention on a further car of the multi-car vehicle. The bearing bracket 2 comprises a bracket 3 that is suitable for being connected to a car of a multi-car vehicle. FIG. 1 shows a wall 24 of the body of the car and the bracket 3 actually being attached to the wall 24 of the car.

The bracket 3 has a connection portion 4 and a rear portion 5 and two support elements 6 that connect the connection portion 4 with the rear portion 5

The connection portion 4 has a hole 7 and a first support surface 8 for a first rubber element 9 and a second support surface 10 for a second rubber element 11. The first support surface 8 and the second support surface 10 are facing in opposite directions.

The rod 2 has an end portion 12. In the embodiment shown in FIGS. 1 and 2, the end portion 12 is made as one-piece with the remainder of the rod 2. The end portion 12 has a support surface 13 for the first rubber element 9 that faces the first support surface 8 of the bracket 3, the first rubber element 9 being placed between the first support surface 8 of the bracket 3 and the support surface 13 of the rod 2.

A pin 14 having a central axis A-A passes through the hole 7 of the bracket, the pin 14 having a support surface 15 for the second rubber element 11 at one end that faces the second support surface 10 of the bracket 3. The second rubber element 11 is placed between the second support surface 10 of the bracket 3 and the support surface 15 of the pin 14. The pin 14 passes through a hole 16 in the end portion 12 of the rod 2. An abutment element 17 in form a screw screwed onto a thread on the end of the pin 14 is provided on the second end of the pin 14. In the first operational state shown in FIG. 1, the abutment element 17 abuts against a wall of the rod 2 that surrounds the hole 16 provided in the end portion 12 of the rod 2.

The bracket 3 comprises a rear portion 5 placed rearward of the connection portion 4. The rear portion is suitable for being connected to the car of a multi-car vehicle by way of having flanges 18 that are screwed to the wall 24. Part of the rear portion 5 is a rear plate 19 that in the embodiment shown if FIGS. 1 and 2 is made up by a part of the wall 24, highlighting that the term assembly in the present invention is only used to identify that group of elements that are relevant for the invention without implying that this group of elements essential for the invention needs to be a group of elements that can be separated from a wall of a car.

The support elements 6 used in this embodiment of the invention are two plates that connect the plate-type connection element 4 to the plate-type flanges 18 of the rear portion 5.

The support surface 15 for the second rubber element 11 provided on the pin 14 is part of an end-plate 20 provided at the first end of the pin. The end-plate 20 is formed as one-piece with the remainder of the pin 14. The end plate has a rearward facing surface that faces the rear plate 19. The rearward facing surface has the shape of a section of the surface of a sphere. In the embodiment shown in FIG. 1, the end plate 20 is arranged distanced from the rear plate 19, because no pushing force is applied to rod 2 that pushes the rod towards the connection portion 4. As shown in FIG. 2, the end plate 20 contacts the rear plate 19. This already takes place, if a pushing force of a first predetermined magnitude is applied to the rod 2 that pushes the rod 2 towards the connection portion 4. As shown in FIG. 2, if the end plate 20 contacts the rear plate 19, the abutment element 17 provided on the second end of the pin 14 comes out of contact with the wall of the rod 2 rod that surrounds the hole 16 provided in the end portion 12 of the rod 2, if a pushing force of a second predetermined magnitude that is larger than the first predetermined magnitude is applied to the rod 2 that pushes the rod 2 towards the connection portion.

The first rubber element 9 and the second rubber element 11 are ring-shaped rubber elements and only shown in section in the FIGS. 1 and 2. The pin 14 passes through these ring-shaped rubber elements.

FIG. 1 shows that a ball 21 is arranged inside the hole 7 of the connection portion. The ball 21 can swivel relative to the connection portion at least about one swivel axis. The pin 14 passes through the ball 21.

The comparison between FIG. 1 and FIG. 2 shows that the first rubber element 9 and the second rubber element 11 are in a compressed state in the operational state of FIG. 1, while FIG. 2 shows that the second rubber element 11 has decompressed somewhat as the pin 14 is pushed rearward, if a pushing force is applied to the rod 2 that pushes the rod 2 towards the connection portion 4.

The hole in the end portion 12 of the rod 2 linearly guides the pin 14 and prevents a swivel movement of the pin 14 relative to the end portion 12 of the rod 2 about a swivel axis that is perpendicular to the central axis A-A of the pin 14.

Figure 3:
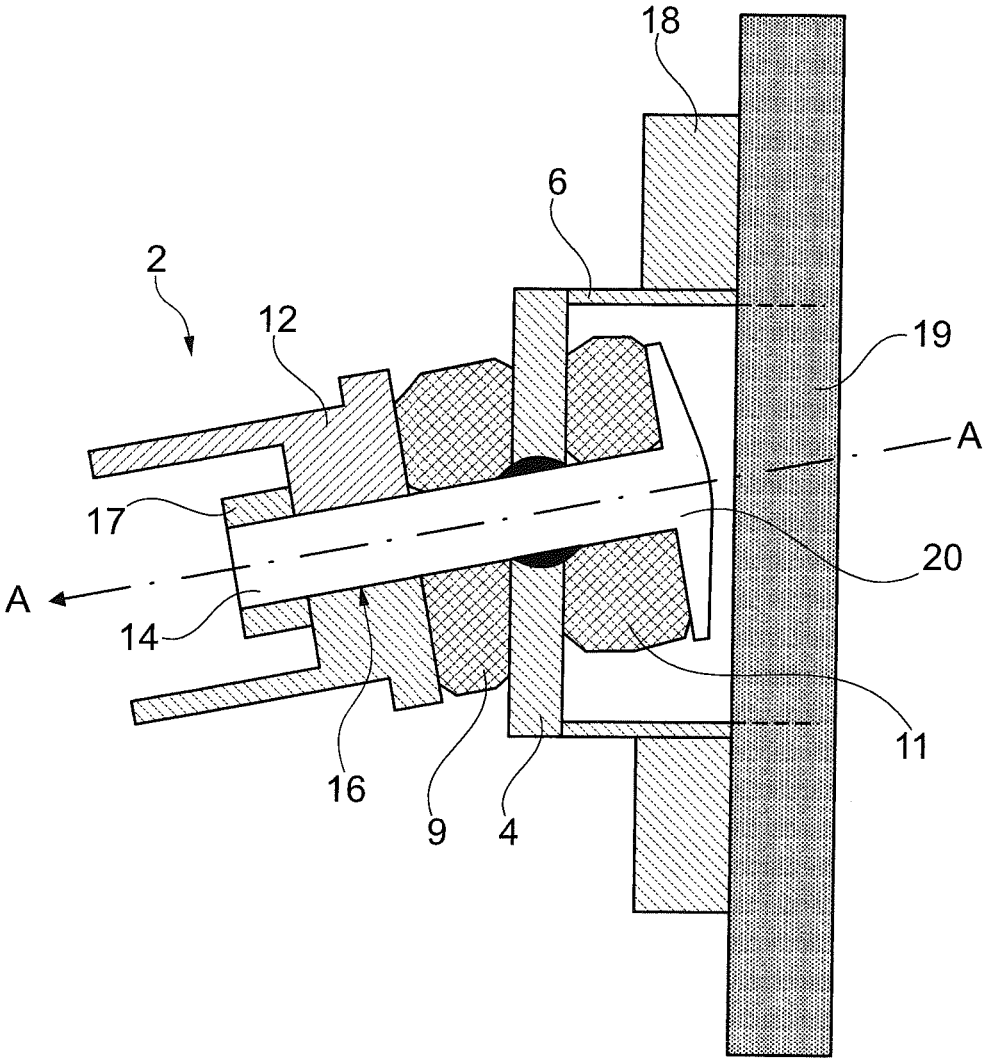
FIG. 3 is a schematic drawing of the embodiment of FIG. 1 in a third operational state.

FIG. 3 shows the embodiment of the FIG. 1 in an operational state, where the rod 2 and the pin 14 have swiveled about the swivel axis that is perpendicular to the central axis A-A and runs through the connection portion 4. As can be seen from FIG. 3, swiveling the rod and the pin 14 about this axis compresses the first rubber element 9 and the second rubber element 11 on one side and allows the first rubber element 9 and the second rubber element 11 to decompress a bit on the other side.

Figure 4:
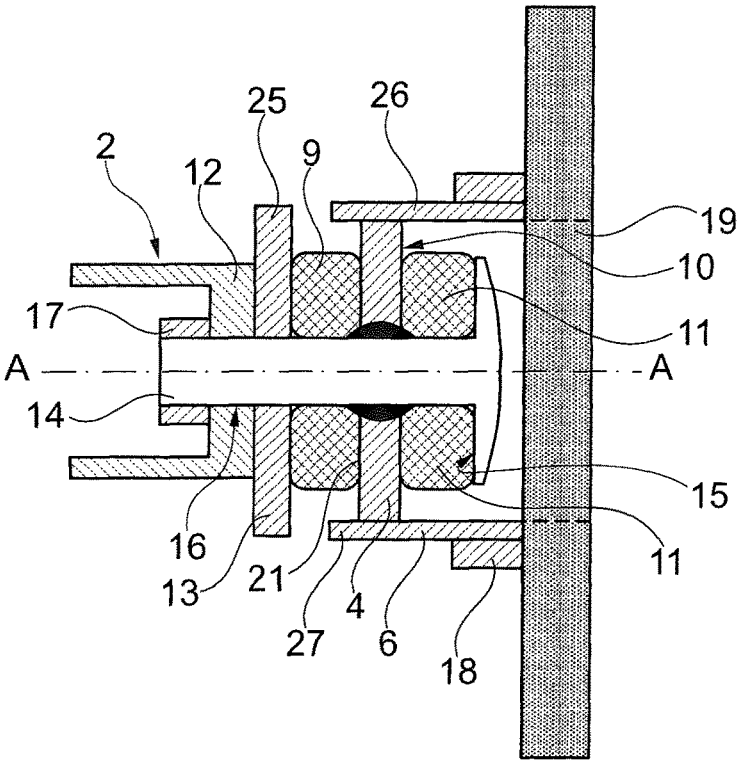
FIG. 4 is a schematic drawing of a second embodiment in a first operational state.
Figure 5:
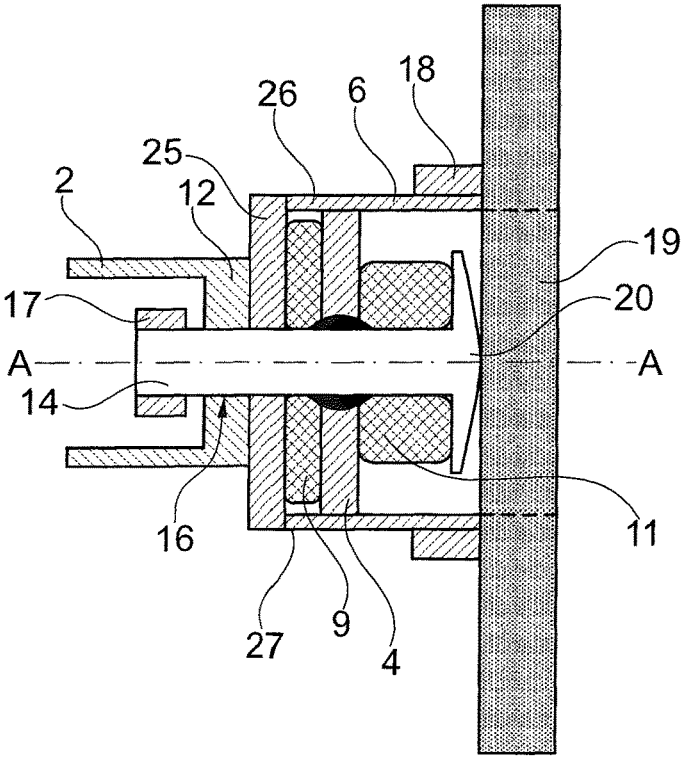
FIG. 5 is a schematic drawing of the embodiment of FIG. 4 in a second operational state and FIG. 6 is a schematic drawing of a third embodiment.
Figure 6:
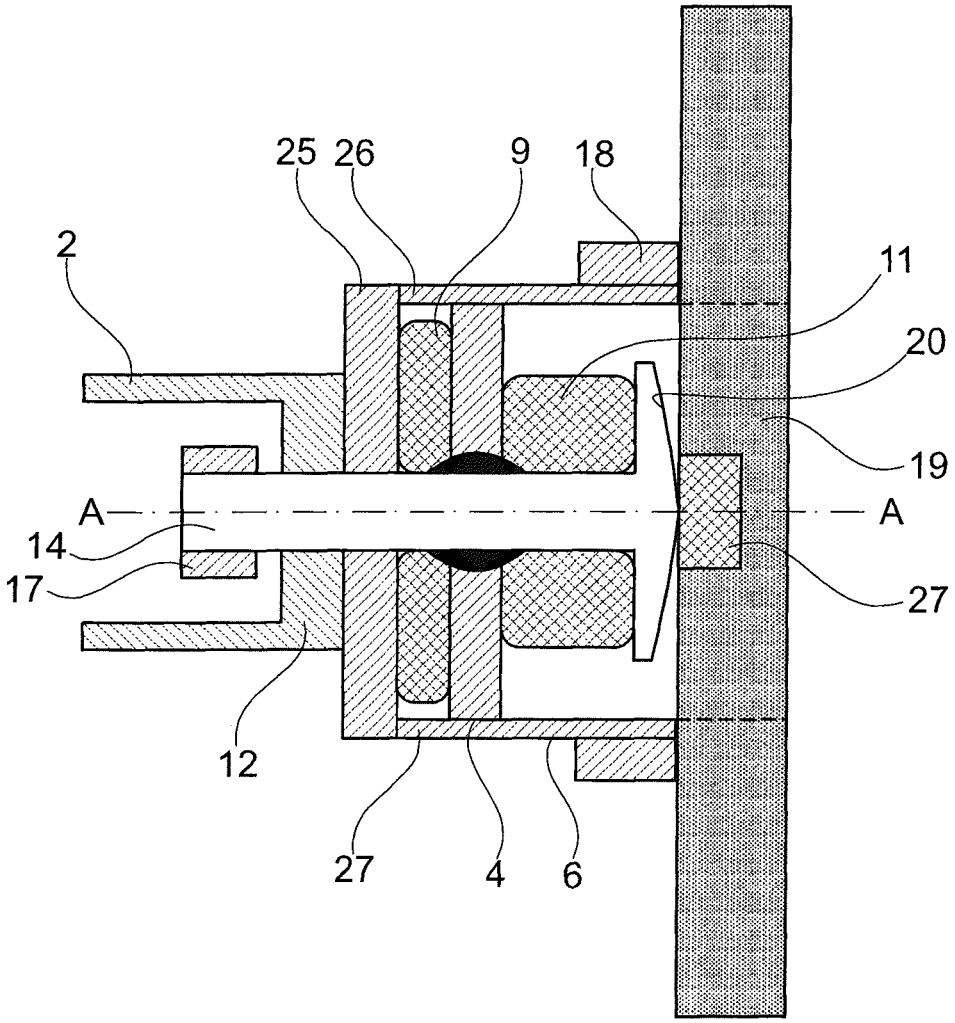

The embodiment of FIGS. 4 and 5 and the embodiment of FIG. 6 largely have the same parts as the embodiment shown in FIGS. 1 to 3. The same parts will be designated with the same reference signs and regarding their functions, placements and interaction, reference is made to the description of the embodiment of FIGS. 1 to 3. The FIG. 4 shows an operational condition similar to the one shown in FIG. 1. The FIG. 5 and FIG. 6 show operational conditions of their respective embodiments similar to the one shown in FIG. 2.

The embodiments shown in FIGS. 4 to 6 differ from the one shown in FIGS. 1 to 3 in that a tilt plate 25 has been introduced between the end-portion 12 of the rod and the first rubber element 9. Also, the embodiment of FIGS. 4 to 6 has protrusion 26 and 27 that protrude from the contact portion 4 towards the tilt plate 25.

As can be seen in FIGS. 5 and 6, if a pushing force of a predetermined magnitude is applied to the rod 2 that pushes the rod 2 towards the connection portion 4, the tilt plate 25 comes into contact with the protrusions 26 and 27. This contact can be used to rectify the relative position of the rod 2 relative to the contact portion 4. If the assembly was in the operational state as shown in FIG. 3, the lower end of the tilt plate 25 would come into contact with the protrusion 27 before the upper end of the tilt plate 25 would come into contact with the protrusion 26. If the pushing force is continued to be applied, this first contact with the protrusion 27 can be used to re-align the rod 2 into a position as shown in FIG. 5, because a return-momentum is created about the contact point between the lower end of the tilt plate 25 and the protrusion 27.

The embodiment of FIG. 6 additionally shows, that an elastic insert in form of a rubber element 28 can inserted into a recess of the wall of the car that forms the rear plate 19. The elastic insert has an outward facing surface that is flush with the remaining surface of the rear plate 19.

What is claimed is:

1. A vehicle coupling assembly comprising:

a bearing bracket including a first bracket comprising:

a connection portion having a connection portion hole formed therethrough, a first side of the connection portion comprising a first connection portion support surface, and a second side of the connection portion comprising a second connection portion support surface, wherein the first connection portion support surface and the second connection portion support surface face in opposite directions;

a rear portion comprising a rear plate, said rear portion configured to be rearward of the connection portion; and at least one support element that connects the connection portion with the rear portion;

a rod comprising an end portion having an end portion wall forming an end portion hole therethrough, wherein a first side of the end portion wall comprises an end portion support surface facing the first connection portion support surface of the first bracket, a pin configured to pass through the connection portion hole of the first bracket and the end portion hole of the rod, the pin including:

a pin support surface, at a first pin end, the pin support surface facing the second connection portion support surface of the first bracket; and an abutment element on a second pin end, the abutment element abutting against a second side of the end portion wall of the rod;

a first compressible element between the first connection portion support surface of the first bracket and the end portion support surface of the rod; and a second compressible element between the second connection portion support surface of the first bracket and the pin support surface;

wherein the size of the at least one support element in a direction of its extension between the connection portion and the rear portion creates sufficient space for the pin to move in and out of contact with the rear plate; and wherein the pin includes a pin end plate at the first pin end of the pin, and wherein the pin end plate is configured to contact the rear plate when a pushing force of a first predetermined magnitude is applied to the rod to push the rod towards the connection portion of the first bracket; and wherein the support element is configured such that a pushing force applied to the rod, in the absence of contact between the pin end plate and the rear plate, is transferred to the support element only via the connection portion.

2. The vehicle coupling assembly of claim 1, wherein the pin support surface comprises a rearward facing surface of the pin end plate that faces the rear plate.

3. The vehicle coupling assembly of claim 2, wherein the pin end plate is configured to be arranged apart from the rear plate when no pushing force is applied to the rod to push the rod towards the connection portion of the first bracket; and wherein, (i) the pin end plate is configured to contact the rear plate; and (ii) the abutment element is configured to come out of contact with the second side of the end portion wall when a pushing force of a second predetermined magnitude that is larger than the first predetermined magnitude is applied to the rod to push the rod towards the connection portion of the first bracket.

4. The vehicle coupling assembly of claim 1, wherein at least one of the first compressible element and the second compressible element comprises a ring-shaped compressible element configured to permit passage of the pin therethrough.

5. The vehicle coupling assembly of claim 1, further comprising a tilt plate arranged between the end portion of the rod and the first compressible element, wherein a portion of the tilt plate is configured to contact with a portion of the connection portion when the rod swivels relative to the connection portion about a swivel axis that is perpendicular to a central axis of the pin.

6. The vehicle coupling assembly of claim 1, wherein the rod comprises one of a connection rod and a coupler rod.

7. A method for vehicle coupling comprising:

providing a vehicle coupling assembly comprising:

a bearing bracket including a first bracket comprising:

a connection portion having a connection portion hole formed therethrough, a first side of the connection portion comprising a first connection portion support surface, and a second side of the connection portion comprising a second connection portion support surface, wherein the first connection portion support surface and the second connection portion support surface face in opposite directions;

a rear portion comprising a rear plate, said rear portion configured to be rearward of the connection portion; and at least one support element that connects the connection portion with the rear portion;

a rod comprising an end portion having an end portion wall forming an end portion hole therethrough, where a first side of the end portion wall comprises an end portion support surface that faces the first connection portion support surface of the first bracket; and a pin configured to pass through the connection portion hole of the first bracket and the end portion hole of the rod, the pin including:

a pin end plate which provides a pin support surface at a first pin end, the pin support surface facing the second connection portion support surface of the first bracket;

an abutment element on a second pin end, the abutment element abutting against a second side of the end portion wall of the rod;

a first compressible element between the first connection portion support surface of the first bracket and the end portion support surface of the rod; and a second compressible element between the second connection portion support surface of the first bracket and the pin support surface;

connecting the rear plate of the first bracket to a first car; and connecting the rod to a second car;

wherein, absent a pushing force urging the rod towards the connection portion of the first bracket, the pin end plate is arranged apart from the rear plate; and wherein, responsive to a pushing force of a first predetermined magnitude urging the rod towards the connection portion of the first bracket, the pin end plate contacts the rear plate; and wherein, responsive to a pushing force of a second predetermined magnitude that is larger than the first predetermined magnitude urging the rod towards the connection portion of the first bracket: (i) the pin end plate contacts the rear plate; and (ii) the abutment element comes out of contact with the second side of the end portion wall.

8. The method of claim 7, wherein the rod comprises a connection rod, and wherein connecting the rod to the second car comprises connecting the connection rod to the second car.

9. The method of claim 7, wherein the rod comprises a coupler rod, and wherein connecting the rod to the second car comprises connecting a first coupler provided on the rod of the first car to a second coupler provided on a second coupler rod of the second car.

10. The method of claim 7, wherein applying the pushing force of the first predetermined magnitude to the rod to push the rod towards the connection portion of the first bracket causes the first compressible element to be compressed and the second compressible element to decompress; and wherein applying the pushing force of the second predetermined magnitude to the rod to push the rod towards the connection portion of the first bracket causes the first compressible element to further compress and the second compressible element to not further decompress.

11. A car of a multi-car vehicle having at least one vehicle coupling assembly for providing a connection to a further car of the multi-car vehicle, the at least one vehicle coupling assembly comprising:

a bearing bracket including a first bracket comprising:

a connection portion having a connection portion hole formed therethrough, a first side of the connection portion comprising a first connection portion support surface, and a second side of the connection portion comprising a second connection portion support surface, wherein the first connection portion support surface and the second connection portion support surface face in opposite directions;

a rear portion comprising a rear plate, said rear portion configured to be rearward of the connection portion; and at least one support element that connects the connection portion with the rear portion;

a rod comprising an end portion having an end portion wall forming an end portion hole therethrough, where a first side of the end portion wall comprises an end portion support surface that faces the first connection portion support surface of the first bracket;

a pin configured to pass through the connection portion hole of the first bracket and the end portion hole of the rod, the pin including:

a pin support surface at a first pin end that faces the second connection portion support surface of the first bracket; and an abutment element on a second pin end, the abutment element abutting against a second side of the end portion wall of the rod;

a first compressible element between the first connection portion support surface of the first bracket and the end portion support surface of the rod; and a second compressible element between the second connection portion support surface of the first bracket and the pin support surface;

wherein the size of the at least one support element in a direction of its extension between the connection portion and the rear portion creates sufficient space for the pin to move in and out of contact with the rear plate; and wherein the pin includes a pin end plate at the first pin end of the pin, and wherein the pin end plate is configured to contact the rear plate when a pushing force of a predetermined magnitude is applied to the rod to push the rod towards the connection portion of the first bracket; and wherein the support element is configured such that a pushing force applied to the rod, in the absence of contact between the pin end plate and the rear plate, is transferred to the support element only via the connection portion.

12. The car of claim 11, wherein the rear plate of the first bracket of the bearing bracket is comprised of a portion of a wall of a body of the car.

13. The car of claim 12, wherein the wall of the body of the car behind the connection portion of the first bracket of the bearing bracket has no hole or recess that is large enough to insert one or both of the first pin end of the pin and the second compressible element.

14. A vehicle coupling assembly comprising:

a bearing bracket including:

a first compressible element;

a second compressible element;

a connection member having a connection member hole therethrough, a first side of the connection member adjacent to a first side of the first compressible element, and a second side of the connection member adjacent to a first side of the second compressible element;

a rear plate, said rear plate configured to be rearward of the connection member; and at least one support element that connects the connection member with the rear plate;

a rod including an end wall having an end wall hole therethrough, wherein a first side of the end wall is adjacent to a second side of the first compressible element and wherein the first compressible element is between the first side of the end wall and the first side of the connection member; and a pin extending through the second compressible element, the connection member hole of the bearing bracket, the first compressible element, and the end wall hole of the rod, the pin movably connecting the bearing bracket and the rod and including:

a pin support surface at a first pin end that faces the second side of the connection member, wherein the second compressible element is between the pin support surface and the second side of the connection member; and an abutment element at a second pin end, the abutment element capable of abutting against a second side of the end wall of the rod;

wherein the size of the at least one support element in a direction of its extension between the connection portion and the rear portion creates sufficient space for the pin to move in and out of contact with the rear plate; and wherein the pin includes a pin end plate at the first pin end of the pin, and wherein the pin end plate is configured to contact the rear plate when a pushing force of a first predetermined magnitude is applied to the rod to push the rod towards the connection portion of the first bracket; and wherein the support element is configured such that a pushing force applied to the rod, in the absence of contact between the pin end plate and the rear plate, is transferred to the support element only via the connection portion.

15. The vehicle coupling assembly of claim 14, wherein the rear plate of the bearing bracket is one of (i) configured for connection to a car of a multi-car vehicle, and (ii) an integral member of the car of the multi-car vehicle.

16. The vehicle coupling assembly of claim 14, wherein the pin support surface comprises a rearward facing surface of the pin end plate that faces the rear plate.

17. The vehicle coupling assembly of claim 16, wherein the pin end plate is configured to be arranged apart from the rear plate when no pushing force is applied to the rod to push the rod towards the connection member of the bearing bracket; and wherein (i) the pin end plate is configured to contact the rear plate, and (ii) the abutment element is configured to come out of contact with the second side of the end wall, responsive to a pushing force of a second predetermined magnitude that is larger than the first predetermined magnitude being applied to the rod to push the rod towards the connection member of the bearing bracket.

18. The vehicle coupling assembly of claim 14, wherein one or both of the first compressible element and the second compressible element comprises a ring-shaped compressible element configured to permit passage of the pin therethrough; and wherein one or both of the first compressible element and the second compressible element is configured to be in a compressed state when no pushing force is applied to the rod to push the rod towards the connection member.

19. The vehicle coupling assembly of claim 14, wherein the end wall hole of the rod is configured to linearly guide the pin and prevent a swivel movement of the pin relative to the end wall of the rod about a swivel axis that is perpendicular to a central axis of the pin.

20. The vehicle coupling assembly of claim 14, further comprising a tilt plate arranged between the end wall hole of the rod and the first compressible element, wherein the end wall hole of the rod is configured to permit a swivel movement of the pin about a swivel axis that is perpendicular to a central axis of the pin; and wherein a portion of the tilt plate is configured to contact with a portion of the connection member when the rod swivels relative to the connection member about the swivel axis.

* * * * *